United States Patent [19]

Boquet et al.

[11] Patent Number: 4,913,474

[45] Date of Patent: Apr. 3, 1990

[54] DEVICE FOR KNOTTING A FLEXIBLE TIE

[75] Inventors: Jean Boquet, Le Perray-en-Yvelines; Georges Guennou, Elancourt, both of France

[73] Assignee: Sica Du Silo De La Rochelle-Pallice, La Rochelle Cedex, France

[21] Appl. No.: 279,151

[22] PCT Filed: Mar. 3, 1988

[86] PCT No.: PCT/FR88/00123

§ 371 Date: Oct. 25, 1988

§ 102(e) Date: Oct. 25, 1988

[87] PCT Pub. No.: WO88/06553

PCT Pub. Date: Sep. 7, 1988

[30] Foreign Application Priority Data

Mar. 3, 1987 [FR] France ..... 8702863

[51] Int. Cl.[4] ..... D04G 5/00; B65B 13/26

[52] U.S. Cl. ..... 289/12; 289/2

[58] Field of Search ..... 289/2, 12, 18.1; 28/211

[56] References Cited

U.S. PATENT DOCUMENTS 2,661,230 12/1953 West ..... 289/12
3,108,831 10/1963 Harper .
4,774,870 10/1988 Yamamoto et al. ..... 289/2

FOREIGN PATENT DOCUMENTS 2053781 4/1971 France .

*Primary Examiner*—Andrew M. Falik
*Attorney, Agent, or Firm*—Cushman, Darby & Cushman

[57] ABSTRACT

A device for knotting a tie comprising a C-shaped rotary member (18) for driving the tie and forming a turn or loop therein, together with a rod movable relative to said C-shaped rotary member that includes a clamp or hook at the end thereof.

13 Claims, 3 Drawing Sheets

DEVICE FOR KNOTTING A FLEXIBLE TIE

FIELD OF THE INVENTION

The invention relates to a device for knotting a flexible tie, such as a strap, string, cord, or tape, etc.

BACKGROUND OF THE INVENTION

There are numerous industrial applications in which a flexible tie needs to be knotted to itself, to another tie, or around some object or support. In general, the knots are tied by hand, which is not always easy in an industrial environment or when the tie or the object which it surrounds is large in size.

There thus exists a need for a device for knotting a flexible tie, which should be simple, effective, compact, and cheap, and which should make it possible to knot a tie automatically in a manner which is rapid and reproducible.

SUMMARY OF THE INVENTION

To this end, the invention proposes a device for knotting a flexible tie, characterized in that it comprises tie support means, a tie displacement member mounted to rotate around the tie in a plane which is oblique relative thereto, drive means for rotating said member through about one turn in order to form a turn or loop in the tie, and tie drawing means for drawing the tie through said turn or loop.

This device thus makes it possible to tie an overhand knot in a tie by means which are simple in structure and easy to operate.

According to another characteristic of the invention, the tie drawing means comprise a clamp or a hook mounted at one end of a rod which is movable in translation along its axis and which forms a support for the tie and is oriented perpendicularly to the tie.

Preferably, the hook mounted at the end of the rod is movable and is connected to drive means for displacing it between a closed position and an open position for grasping and releasing the tie.

In a preferred embodiment of the invention, the tie displacement member comprises a C-shaped rotary support having a finger mounted thereon extending perpendicularly to the plane of said support.

When the C-shaped rotary member is engaged around the tie, and is rotated, the finger carried thereby bears against the tie to form a loop or turn in the tie.

Thereafter, a knot can be tied merely by pulling the tie through the turn or loop formed in this way.

The stroke of the rod carrying the tie-grasping clamp or hook may be limited so as to draw a loop of the tie through the above-mentioned turn or loop of the tie.

Then, the knot can be untied merely by pulling on the end of the tie.

The device of the invention has a very wide and varied range of applications in numerous types of industry. It may be used, in particular, for knotting ties around bundles of objects to be transported.

BRIEF DESCRIPTION OF THE DRAWINGS

The invention will be better understood, and other details, characteristics, and advantages thereof will appear more clearly on reading the following description which is given by way of example and with reference to the accompanying drawings, in which.

DETAILED DESCRIPTION OF THE PREFERRED EXEMPLARY EMBODIMENTS

Reference is made initially to FIGS. 1 to 4 which show the structure of an embodiment of a knotting device in accordance with the invention.

Figure 1:
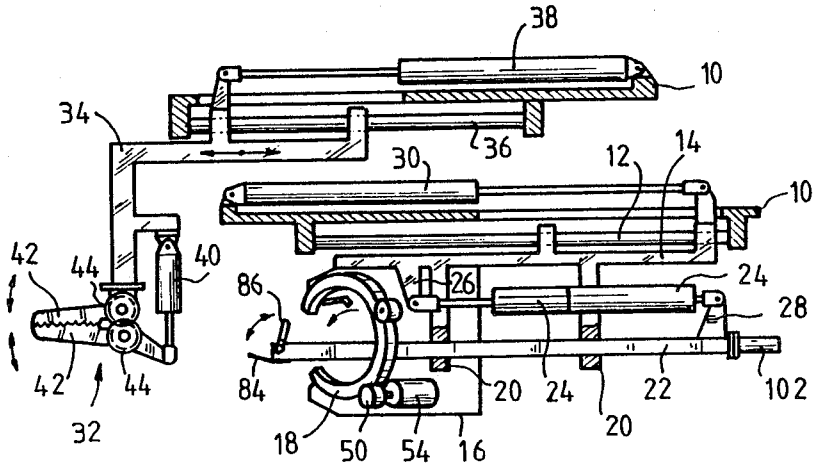
FIG. 1 is a diagrammatic side view of a knotting device in accordance with the invention and including automatic tie support clamps.

As shown in FIG. 1, this device comprises a fixed frame 10 including a rod 12 for guiding a slide 14 which is fixed to the frame 16 for a C-shaped rotary member 18 whose plane extends obliquely relative to the guide rod 12 of the slide 14.

The slide also carries two bushings 20 for guiding a rod 22 in translation, with the rod extending through the rotary member 18 and being displaced in translation along its axis parallel to the guide rod 12 by one or more coupled actuators 24 which are parallel to the moving rod 22. For example, the piston rod of one of the actuators 24 may be connected to the slide 14 via a bracket 26 whereas the piston rod of the second actuator is connected to the moving rod 22 by a bracket 28. The slide 14 is displaced in translation along the guide rod 12 by an actuator 30.

The device of the invention also comprises one or two tie-holding clamps 32 which are disposed in the vicinity of the rotary member 18 of the moving rod 22, for example by being disposed on either side thereof. Each clamp 32 comprises a slide 34 which is guided in translation on a rod 36 of the frame 10 and is displaceable along said rod by an actuator 38. The slide 34 carries an actuator 40 for opening and closing two jaws 42 of the clamp with each of the jaws being rotatable about a horizontal axis and being interconnected by two meshing gear wheels 44.

Figure 2:
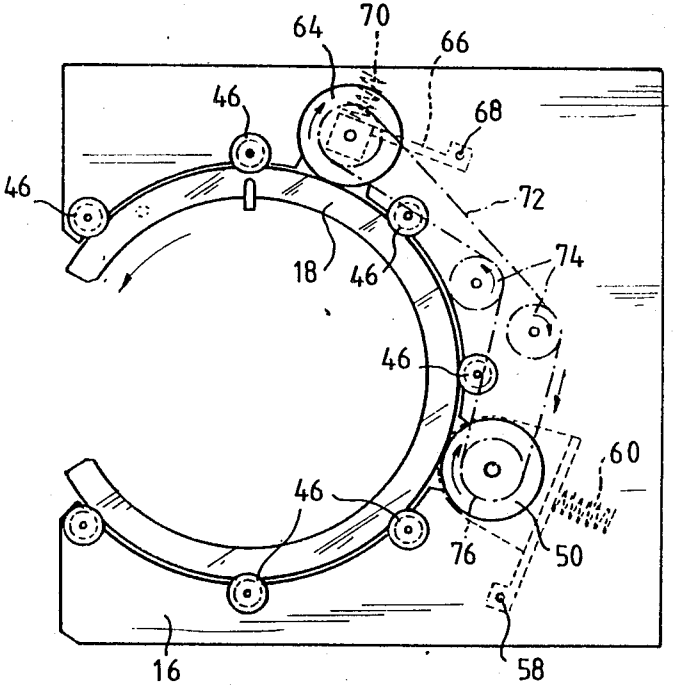
FIGS. 2 and 3 are a diagrammatic front view and side view of the rotary member constituting a portion of said device, together with its rotary drive means.
Figure 3:
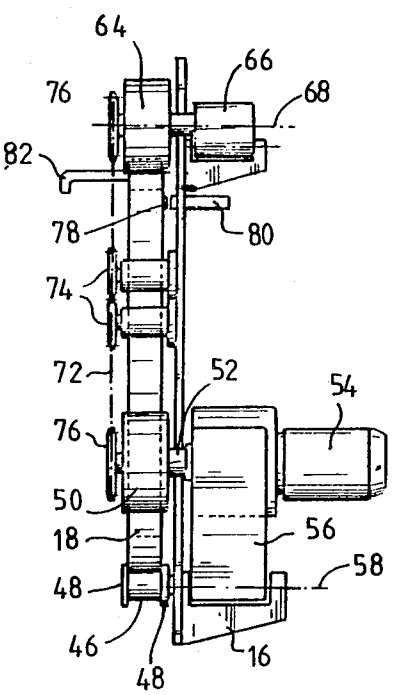

Reference is now made more particularly to FIGS. 2 and 3 which show the rotary member of the knotting device in greater detail.

This C-shaped rotary member 18 is constituted by a circular ring having a gap over about 60° in order to enable it to be engaged around the tie to be knotted when the frame 16 carried by the slide 14 is displaced towards the tie.

The C-shaped rotary member is supported by the frame 16 and is guided by means of wheels 46 including circular cheeks 48 for holding the rotary member.

The drive means for rotating the rotary member 18 comprise a drive wheel 50 mounted on the outlet shaft 52 of a motor and stepdown gear unit 54 carried by a support plate 56 which is pivotally mounted on the frame 16 about an axis 58 which is parallel to the axis of rotation of the rotary member 18. The support plate 56 is urged by a spring 60 towards the rotary member 18 in such a manner that the drive wheel is always pressed against the periphery of the rotary member 18. Another drive wheel 64 may be associated with the rotary member 18 and angularly offset by about 90° from the first drive wheel 50. The second drive wheel 64 is mounted on a support 56 which pivots about an axis 68 parallel to the axis of rotation of the member 18 and which is urged by a spring 70 in such a manner as to press the wheel 64 against the periphery of the member 18. The drive wheels 50 and 64 are interconnected by a chain 72 passing over deflecting sprocket wheels 74 and over sprocket wheels 76 fixed to the shafts of the wheels 50 and 64.

An element 78 for triggering a detector 80 is fixed on one side of the rotary member 18 and serves, for example, to stop the drive to the rotary member after one full turn.

A finger 82 which extends perpendicularly to the plane of the rotary member 18 is fixed on a side face thereof, e.g. in the vicinity of one of its ends.

Figure 4:
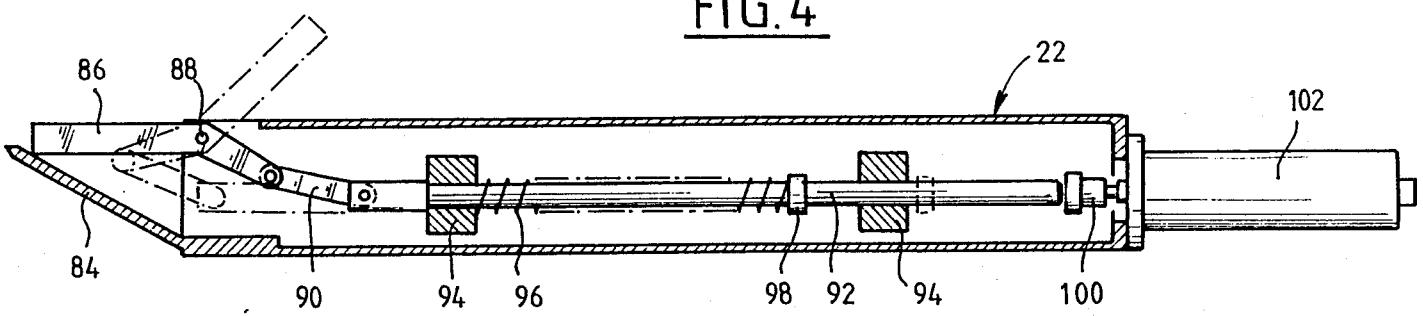
FIG. 4 is a diagrammatic longitudinal section through the rod and tie-grasping means forming a part of said device.

FIG. 4 shows the structure of the moving rod 22 which extends through the rotary member 18 in greater detail. This rod 22 is tubular and includes, at its end adjacent to the rotary member 18, a fixed lug 84 with which it co-operates with the end of a crank lever 86 rotatably mounted on the tubular rod 22 about a transverse axis 88 and connected by a link 90 to the end of a cylindrical rod 92 which is guided in translation inside the moving rod 22 by bushings 94.

This cylindrical rod 92 is associated with a return spring 96 bearing against one of the bushings 94 and against an abutment 98 fixed on the cylindrical rod 92. The end of the rod 92 furthest from the link 90 co-operates by abutment with the end of the piston rod 100 of an actuator 102 shows cylinder is fixed to the moving rod 22 at its end furthest from the lug 84. When the piston rod is retracted into the actuator 102, the return spring 96 relaxes and displaces the cylindrical rod 92 in a direction corresponding to the clamp constituted by the lug 84 and the lever 86 being closed. This position is shown in solid lines in FIG. 4. However, when the piston rod 100 is extended from the actuator 102, the rod 92 is displaced towards the open end of the tubular rod 22 and displaces the lever 86 into the position shown in dot-dashed lines, which corresponds to the clamp being opened.

The operation of the device in accordance with the invention is described with reference to FIGS. 5*a* to 5*e*.

In the example shown in the figures, a flexible tie 104 is to be knotted onto another flexible tie 106. The two ties extend parallel to each other and perpendicularly to the direction of displacement of the moving rod 22. They are held, for example, by the two clamps 32 situated on either side of the knotting device.

Figure 5A:
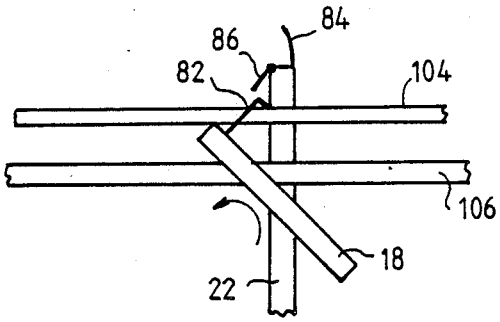
FIGS. 5*a* to 5*e* are diagrams showing the operation of said device and the tying of a knot.

In the initial position shown in FIG. 5*a*, the frame 16 has been displaced towards the ties 104 and 106 by the actuator 30 until the rotary member 18 is engaged around the ties 104 and 106, and the moving rod 22 has been moved by the actuators 24 beneath the ties 104 and 106 until its end carrying the lug 84 and the moving lever 86 lies slightly beyond the tie 104. In this position, the ties 104 and 106 can rest on the moving rod 22.

Figure 5D:
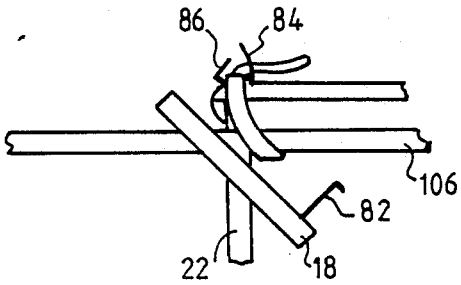
Figure 5B:
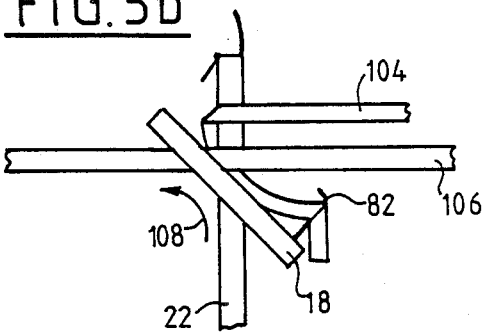

The rotary member 18 is then caused to rotate through one turn in the direction indicated by arrow 108 (FIG. 5*b*). As it rotates, the finger 82 carried by the rotary member 18 presses against the tie 104 and at the end of the first half turn causes said tie to pass beneath the moving rod 22 and beneath the other tie 106. The rotation of the rotary member 18 continues and, at the end of its second half turn as shown in FIG. 5*c*, the finger 82 of the rotary member 18 has brought the tie 104 above the moving rod 22 and the other tie 106, thus forming a turn or loop of the tie 104 around the moving rod 22 and the other tie 106. The moving rod 22 can then be moved a little way rearwardly such that, at the end of one complete turn of the member 18, the finger 82 places the tie 104 in the open clamp formed by the lug 84 and the moving lever 86.

Thereafter, it suffices to close the clamp by rotating the moving lever 86 as shown in FIG. 5*d*. In order to avoid any interference, the rotary member 18 may be driven through another half turn in order to occupy the position shown in position 5*d*.

Thereafter the moving rod 22 is displaced rearwardly, thereby drawing a length of the tie 104 through the turn or loop previously formed around the other tie 106. Depending on the free length of said drawn portion of the tie 104 and on the rearwards stroke of the moving rod 22, it is possible either to draw a loop of the tie 104 through the previously formed loop, as shown in FIG. 5*e*, or else to pull the tie 104 right through said loop and form an overhand knot.

The clamp mounted at the end of the moving rod 22 is then opened by pivoting the lever 86 and the rotary member 18 is then returned to its FIG. 5*a* position and is moved back in order to completely disengage the tie 106 in which case the stroke of the tie drawing rod 22 has a stroke that will draw tie 104 through the turn or loop previously formed around the other tie 106.

A sliding knot of the tie 104 is thus formed on the tie 106.

Figure 5E:
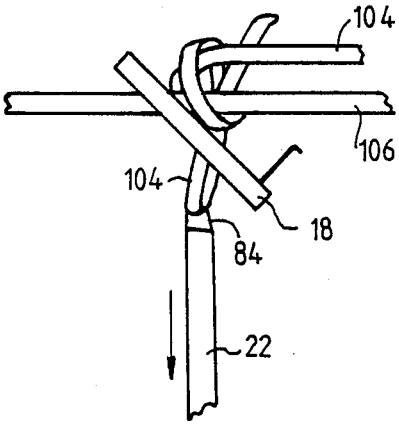
Figure 5C:
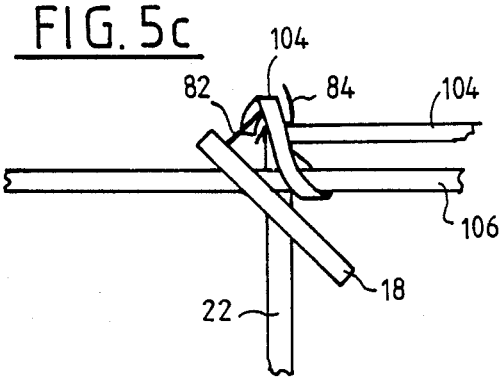

The device of the invention may naturally be used with a single flexible tie or with a plurality of ties as shown in FIGS. 5*a* to 5*e*. The knot formed may be an overhand knot or a knot as shown in FIG. 5*e* which is very easily undone by pulling on the free end of the tie 104.

What is claimed is:

1. A device for knotting a flexible tie comprising tie support means, a tie displacement member mounted to rotate around the tie in a plane which is oblique relative thereof, said member comprising a C-shaped rotary support having a finger mounted thereon extending perpendicularly to said plane, drive means for rotating said member through about one turn in order to form a turn in the tie, and tie drawing means for drawing the tie through said turn, said tie drawing means comprising a tie engaging device mounted at an end of a rod, said rod having an axis and being movable therealong in a direction oriented perpendicularly to the tie.

2. A device according to claim 1, wherein the finger (82) is fixed to the C-shaped rotary support (18) in the vicinity of one end thereof.

3. A device according to claim 1, wherein the rotary support (18) is guided in rotation on a moving frame (16) by wheels (46, 50, 64) at least one of which is connected to the outlet shaft (52) of a motor (54) in order to constitute the drive means for rotating the rotary support (18).

4. A device according to claim 3, wherein the moving frame (16) is mounted on a fixed frame (10) so as to be movable in translation parallel to the axis of said rod (22) between a position where the C-shaped rotary support (18) is engaged around the tie (104) and a position where the rotary support (18) is at a distance from the tie, and drive means for moving said moving frame.

5. A device according to claim 3 wherein the moving frame (16) also supports said rod (22), together with means (20, 24) for guiding it and displacing it in translation.

6. A device according to claim 13, wherein the tie engaging device mounted at the end of the rod (22) is movable and is connected to drive means (90, 92, 96, 102) displacing it between a closed position and an open position for grasping and releasing the tie (104).

7. A device according to claim 6, wherein said rod (22) is tubular and in that the tie engaging device drive means (86) further comprises an actuator (102) and a piston rod, said piston rod being received inside said tubular rod (22).

8. A device according to claim 1, further including at least one additional means for supporting and holding the tie (104) placed in the vicinity of the rod (22) and of said displacement member (18).

9. A device according to claim 1, wherein the tie drawing means (22, 86) for drawing the tie through said turn have a stroke which is limited so as to draw a loop of the tie through the turn.

10. A device as in claim 9, wherein said at least one additional means comprises a clamp.

11. A device according to claim 1, wherein the tie support means supports a second tie (106) parallel to said tie (104) said tie (104) being knotted about said second tie.

12. A device as in claim 1, wherein said tie engaging device includes a clamp.

13. A device as in claim 1, wherein said tie engaging device includes a hook.

* * * * *